US011688338B2

(12) United States Patent
Feng et al.

(10) Patent No.: US 11,688,338 B2
(45) Date of Patent: Jun. 27, 2023

(54) DISPLAY DEVICE, LUMINANCE COMPENSATION CIRCUIT THEREOF AND LUMINANCE COMPENSATION METHOD

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Lei Feng, Beijing (CN); Guoqiang Wu, Beijing (CN); Chenghao Liao, Beijing (CN); Yanni Jiang, Beijing (CN); Chungkee Cheng, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/430,234

(22) PCT Filed: Nov. 13, 2020

(86) PCT No.: PCT/CN2020/128734

§ 371 (c)(1),
(2) Date: Aug. 11, 2021

(87) PCT Pub. No.: WO2022/099624

PCT Pub. Date: May 19, 2022

(65) Prior Publication Data

US 2022/0157236 A1 May 19, 2022

(51) Int. Cl.
*G09G 3/3225* (2016.01)

(52) U.S. Cl.
CPC ... *G09G 3/3225* (2013.01); *G09G 2300/0439* (2013.01); *G09G 2310/08* (2013.01);
(Continued)

(58) Field of Classification Search
CPC ..... G09G 3/3225; G09G 2300/0439; G09G 2310/08; G09G 2320/0233; G09G 2320/073; G09G 2330/021
See application file for complete search history.

(56) References Cited

U.S. PATENT DOCUMENTS

2014/0022152 A1 1/2014 Guo et al.
2016/0035277 A1 2/2016 Han et al.
(Continued)

FOREIGN PATENT DOCUMENTS

CN 108717244 A 10/2018
CN 108877676 A 11/2018
(Continued)

*Primary Examiner* — Kenneth Bukowski
(74) *Attorney, Agent, or Firm* — Muncy, Geissler, Olds & Lowe, P.C.

(57) ABSTRACT

A display device, a luminance compensation circuit thereof and a luminance compensation method are provided. In the luminance compensation method, the display device includes a display region and a peripheral region located on a periphery of the display region, where the display region includes a first pixel region and a second pixel region, a pixel density of the second pixel region is lower than a pixel density of the first pixel region; the luminance compensation method includes: adjusting a power supply signal of the first pixel region and/or a power supply signal of the second pixel region, respectively, according to the first light-emitting luminance information of the first pixel region and the second light-emitting luminance information of the second pixel region.

16 Claims, 6 Drawing Sheets

(52) U.S. Cl.
CPC ..... *G09G 2320/0233* (2013.01); *G09G 2320/0673* (2013.01); *G09G 2330/021* (2013.01)

(56) References Cited

U.S. PATENT DOCUMENTS

| | | | | |
|---|---|---|---|---|
| 2016/0322446 | A1* | 11/2016 | Park | G09G 3/3266 |
| 2017/0076654 | A1 | 3/2017 | Wang | |
| 2019/0325828 | A1* | 10/2019 | Zhang | G09G 3/3258 |
| 2020/0051508 | A1 | 2/2020 | Tan et al. | |
| 2020/0135147 | A1* | 4/2020 | Tang | G09G 3/3208 |
| 2020/0152134 | A1 | 5/2020 | Lee et al. | |
| 2020/0211480 | A1 | 7/2020 | Xiang et al. | |
| 2020/0234634 | A1* | 7/2020 | Li | G09G 3/3208 |
| 2020/0280010 | A1* | 9/2020 | Jiang | H01L 27/322 |
| 2021/0065625 | A1* | 3/2021 | Wang | H10K 59/35 |
| 2021/0134242 | A1* | 5/2021 | Hei | G09G 5/02 |
| 2021/0233449 | A1 | 7/2021 | Zuo et al. | |
| 2022/0059011 | A1* | 2/2022 | Li | G07F 17/3213 |

FOREIGN PATENT DOCUMENTS

| | | | |
|---|---|---|---|
| CN | 108922900 | A | 11/2018 |
| CN | 109637457 | A | 4/2019 |
| CN | 109979389 | A | 7/2019 |
| CN | 110379350 | A | 10/2019 |
| CN | 110599957 | A | 12/2019 |
| CN | 110610680 | A | 12/2019 |
| CN | 110619836 | A | 12/2019 |
| CN | 110718190 | A | 1/2020 |
| CN | 110767158 | A | 2/2020 |
| CN | 110767168 | A | 2/2020 |
| CN | 110956925 | A | 4/2020 |
| CN | 111179798 | A | 5/2020 |
| CN | 111477097 | A | 7/2020 |
| CN | 111862873 | A | 10/2020 |

* cited by examiner

DISPLAY DEVICE, LUMINANCE COMPENSATION CIRCUIT THEREOF AND LUMINANCE COMPENSATION METHOD

CROSS REFERENCE OF RELATED APPLICATION

This application is the U.S. national phase of PCT Application PCT/CN2020/128734 filed on Nov. 13, 2020, which is incorporated in their entirety by reference herein.

TECHNICAL FIELD

The present disclosure relates to the field of display technologies, and in particular to a display device, a luminance compensation circuit thereof and a luminance compensation method.

BACKGROUND

Compared with conventional liquid crystal display panels, active-matrix organic light-emitting diode (AMOLED) display panels have advantages of self-illumination, bright colors, high reaction speed and bendability, so they are widely used.

In order to increase a screen-to-body ratio of the AMOLED display panels and make greater use of the screen display, a "H+L" full-screen display scheme is proposed in the related art, that is, a screen is divided into a small part of a low-resolution display area (L-area) above and a large part of a high-resolution display area (H-area) below, with only part of pixels in the low-resolution display area displayed normally. A camera module or infrared light sensor is set under the L area, and a translucent display of the L-area is achieved by utilizing ultra-thin characteristics of the AMOLED, enabling the camera module or infrared light sensor to receive light through the L-area. The above display scheme avoids digging holes inside the display panel, and realizes a true full-screen display.

SUMMARY

The purpose of the present disclosure is to provide a display device and a luminance compensation circuit thereof and a luminance compensation method.

According to a first aspect of the present disclosure, a luminance compensation method for a display device is provided, and the display device includes: a display region and a peripheral region located on a periphery of the display region, where the display region includes a first pixel region and a second pixel region, a pixel density of the second pixel region is lower than a pixel density of the first pixel region; the luminance compensation method includes: obtaining first light-emitting luminance information of the first pixel region and second light-emitting luminance information of the second pixel region; adjusting a power supply signal of the first pixel region and/or a power supply signal of the second pixel region, respectively, according to the first light-emitting luminance information of the first pixel region and the second light-emitting luminance information of the second pixel region.

Optionally, the power supply signal includes a first power supply signal and/or a second power supply signal; the first power supply signal is configured to generate a drive signal for driving pixels to emit light, and a cathode of each pixel in the display device is connected to the second power supply signal.

Optionally, when the power supply signal includes the first power supply signal, the adjusting the power supply signal of the first pixel region and/or the power supply signal of the second pixel region, respectively, specifically includes: decreasing a voltage value of the first power supply signal of the first pixel region and/or increasing a voltage value of the first power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region; increasing a voltage value of the first power supply signal of the first pixel region and/or decreasing a voltage value of the first power supply signal of the second pixel region when it is determined that light-emitting luminance of the first pixel region is lower than light-emitting luminance of the second pixel region according to the first light-emitting luminance information of the first pixel region and the second light-emitting luminance information of the second pixel region.

Optionally, when the power supply signal includes the second power supply signal, the adjusting the power supply signal of the first pixel region and/or the power supply signal of the second pixel region, respectively, specifically includes: increasing a voltage value of the second power supply signal of the first pixel region and/or decreasing a voltage value of the second power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region; decreasing a voltage value of the second power supply signal of the first pixel region and/or increasing a voltage value of the second power supply signal of the second pixel region when it is determined that light-emitting luminance of the first pixel region is lower than light-emitting luminance of the second pixel region according to the first light-emitting luminance information of the first pixel region and the second light-emitting luminance information of the second pixel region.

Optionally, the adjusting the power supply signal of the first pixel region and/or the power supply signal of the second pixel region, respectively, specifically includes: controlling an integrated power supply circuit to adjust the power supply signal provided to the first pixel region and/or the second pixel region.

Optionally, the display device further includes a first Gamma circuit and a second Gamma circuit; the luminance compensation method further includes: controlling the first Gamma circuit to generate a first Gamma voltage signal according to the first light-emitting luminance information of the first pixel region and the second light-emitting luminance information of the second pixel region, and generating, according to the first Gamma voltage signal, a first data signal to be transmitted to the first pixel region; controlling the second Gamma circuit to generate a second Gamma voltage signal according to the first light-emitting luminance information of the first pixel region and the second light-emitting luminance information of the second pixel region, and generating, according to the second Gamma voltage signal, a second data signal to be transmitted to the second pixel region.

Optionally, when it is determined that light-emitting luminance of the first pixel region is higher than light-emitting luminance of the second pixel region according to the first light-emitting luminance information of the first pixel region and the second light-emitting luminance information of the second pixel region, a range of the first Gamma voltage signal generated by the first Gamma circuit is controlled to increase, the first data signal to be transmitted to the first pixel region is generated according to the first Gamma voltage signal with the increased range; or, a range of the second Gamma voltage signal generated by the second Gamma circuit is controlled to decrease, the second data signal to be transmitted to the second pixel region is generated according to the second Gamma voltage signal with the decreased range.

When it is determined that light-emitting luminance of the first pixel region is lower than light-emitting luminance of the second pixel region according to the first light-emitting luminance information of the first pixel region and the second light-emitting luminance information of the second pixel region, a range of the first Gamma voltage signal generated by the first Gamma circuit is controlled to decrease, the first data signal to be transmitted to the first pixel region is generated according to the first Gamma voltage signal with the decreased range; or, a range of the second Gamma voltage signal generated by the second Gamma circuit is controlled to increase, the second data signal to be transmitted to the second pixel region is generated according to the second Gamma voltage signal with the increased range.

Based on the above technical solution of the luminance compensation method for the display device, a luminance compensation circuit for a display device are provided according to a second aspect of the present disclosure, and the display device includes: a display region and a peripheral region located on a periphery of the display region, where the display region includes a first pixel region and a second pixel region, a pixel density of the second pixel region is lower than a pixel density of the first pixel region; the luminance compensation circuit includes a driver IC.

The driver IC is configured to obtain first light-emitting luminance information of the first pixel region and second light-emitting luminance information of the second pixel region.

The driver IC is further configured to adjust a power supply signal of the first pixel region and/or a power supply signal of the second pixel region, respectively, according to the first light-emitting luminance information of the first pixel region and the second light-emitting luminance information of the second pixel region.

Optionally, the power supply signal includes a first power supply signal and/or a second power supply signal; the first power supply signal is configured to generate a drive signal for driving pixels to emit light, and a cathode of each pixel in the display device is connected to the second power supply signal.

Optionally, when the power supply signal includes the first power supply signal, the driver IC is further configured to: decrease a voltage value of the first power supply signal of the first pixel region and/or increase a voltage value of the first power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region; increase a voltage value of the first power supply signal of the first pixel region and/or decrease a voltage value of the first power supply signal of the second pixel region when it is determined that light-emitting luminance of the first pixel region is lower than light-emitting luminance of the second pixel region according to the first light-emitting luminance information of the first pixel region and the second light-emitting luminance information of the second pixel region.

Optionally, when the power supply signal includes the second power supply signal, the driver IC is further configured to: increase a voltage value of the second power supply signal of the first pixel region and/or decrease a voltage value of the second power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region; decrease a voltage value of the second power supply signal of the first pixel region and/or increase a voltage value of the second power supply signal of the second pixel region when it is determined that light-emitting luminance of the first pixel region is lower than light-emitting luminance of the second pixel region according to the first light-emitting luminance information of the first pixel region and the second light-emitting luminance information of the second pixel region.

Optionally, the luminance compensation circuit further includes an integrated power supply circuit, and the integrated power supply circuit is used to supply power to the driver IC.

The driver IC is further configured to: control the integrated power supply circuit to adjust the power supply signal provided to the first pixel region and/or the second pixel region.

Optionally, the luminance compensation circuit further includes an integrated power supply circuit, and the integrated power supply circuit is used to supply power to the driver IC.

The driver IC is further configured to: control the integrated power supply circuit to adjust the power supply signal provided to the first pixel region.

The driver IC is further configured to: directly adjust the power supply signal provided to the second pixel region.

Optionally, the driver IC includes a control sub-circuit, a first Gamma circuit and a second Gamma circuit.

The control sub-circuit is configured to: control the first Gamma circuit to generate a first Gamma voltage signal according to the first light-emitting luminance information of the first pixel region and the second light-emitting luminance information of the second pixel region, and generate a first data signal to be transmitted to the first pixel region according to the first Gamma voltage signal.

The control sub-circuit is further configured to: control the second Gamma circuit to generate a second Gamma voltage signal according to the first light-emitting luminance information of the first pixel region and the second light-emitting luminance information of the second pixel region, and generate a second data signal to be transmitted to the second pixel region according to the second Gamma voltage signal.

Optionally, the control sub-circuit is further configured to: when it is determined that light-emitting luminance of the first pixel region is higher than light-emitting luminance of the second pixel region according to the first light-emitting luminance information of the first pixel region and the second light-emitting luminance information of the second pixel region, control a range of the first Gamma voltage signal generated by the first Gamma circuit to increase, generate the first data signal transmitted to the first pixel region according to the first Gamma voltage signal with the increased range; or, control a range of the second Gamma voltage signal generated by the second Gamma circuit to decrease, generate the second data signal transmitted to the second pixel region according to the second Gamma voltage signal with the decreased range; when it is determined that light-emitting luminance of the first pixel region is lower than light-emitting luminance of the second pixel region according to the first light-emitting luminance information of the first pixel region and the second light-emitting luminance information of the second pixel region, control a range of the first Gamma voltage signal generated by the first Gamma circuit to decrease, generate the first data signal transmitted to the first pixel region according to the first Gamma voltage signal with the decreased range; or, control a range of the second Gamma voltage signal generated by the second Gamma circuit to increase, generate the second data signal transmitted to the second pixel region according to the second Gamma voltage signal with the increased range.

Based on the above technical solution of the luminance compensation circuit of the display device, a display device is provided according to a third aspect of the present disclosure, and the display device includes the above luminance compensation circuit.

Based on the above technical solution of the luminance compensation method for the display device, a luminance compensation circuit of a display device is provided according to a fourth aspect of the present disclosure, the luminance compensation circuit of the display device includes: a processor and a memory, where the memory stores computer executable instructions, when the computer executable instructions is performed by the processor, the luminance compensation method for the display device is implemented.

Based on the above technical solution of the luminance compensation method for the display device, a non-volatile storage media storing computer executable instructions thereon is provided according to a fifth aspect of the present disclosure, when the computer executable instructions is performed by a processor, the luminance compensation method for the display device is implemented.

BRIEF DESCRIPTION OF THE DRAWINGS

The drawings described herein are used to provide a further understanding of the present disclosure and constitute a part of the present disclosure. The exemplary embodiments of the present disclosure and the description thereof are used to explain the present disclosure, and do not constitute an improper limitation on the present disclosure. In the drawings.

DETAILED DESCRIPTION

In order to further explain the display device, the luminance compensation circuit thereof and the luminance compensation method provided in the embodiments of the present disclosure, the following describes in detail with reference to the accompanying drawings of the description.

In the H+L full-screen display scheme, due to different lighting conditions of pixels in the L-area and the H-area, it appears that H-area aging situation is heavier than the L-area in a process of long-term touch screen. The aging causes current capacity to decrease, causing nonuniformity in the luminance in the two areas where there are no difference after Gamma adjustment. Therefore, there is an urgent need to propose a compensation scheme that improves aging and enhances luminance uniformity.

Figure 5:
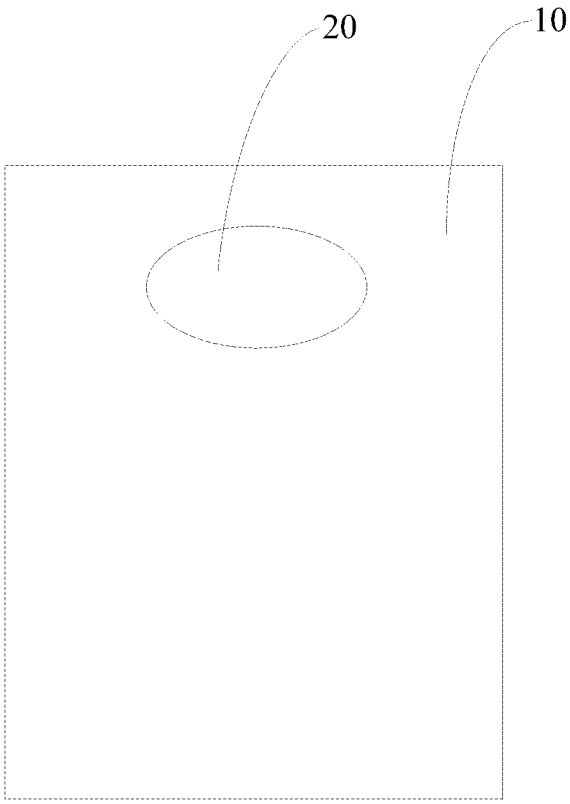
FIG. 5 is a fifth schematic diagram of a first pixel region and a second pixel region provided in an embodiment of the present disclosure.
Figure 6:
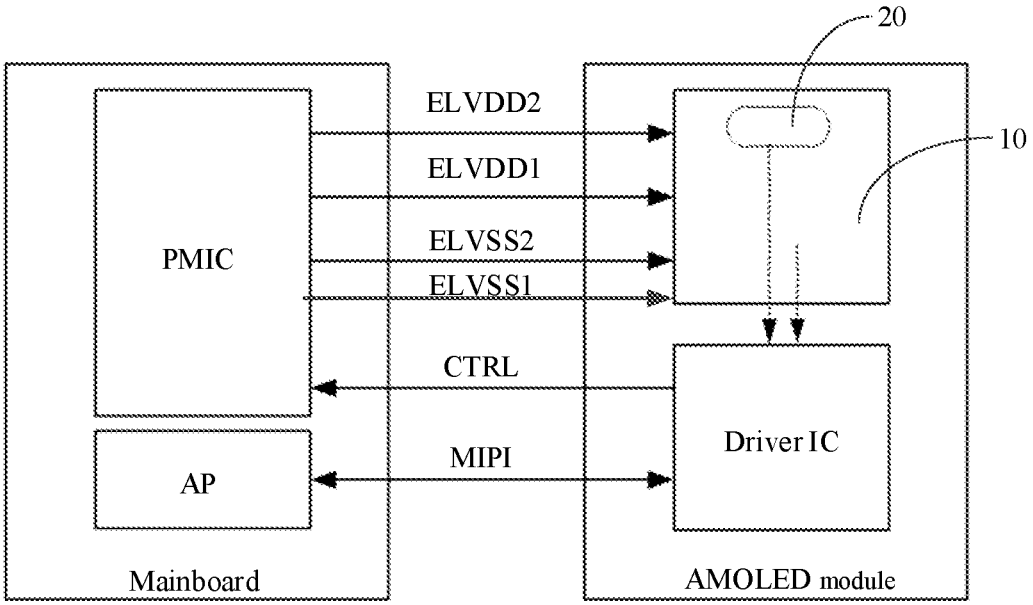
FIG. 6 is a first schematic structural diagram of a display device provided in an embodiment of the present disclosure.
Figure 7:
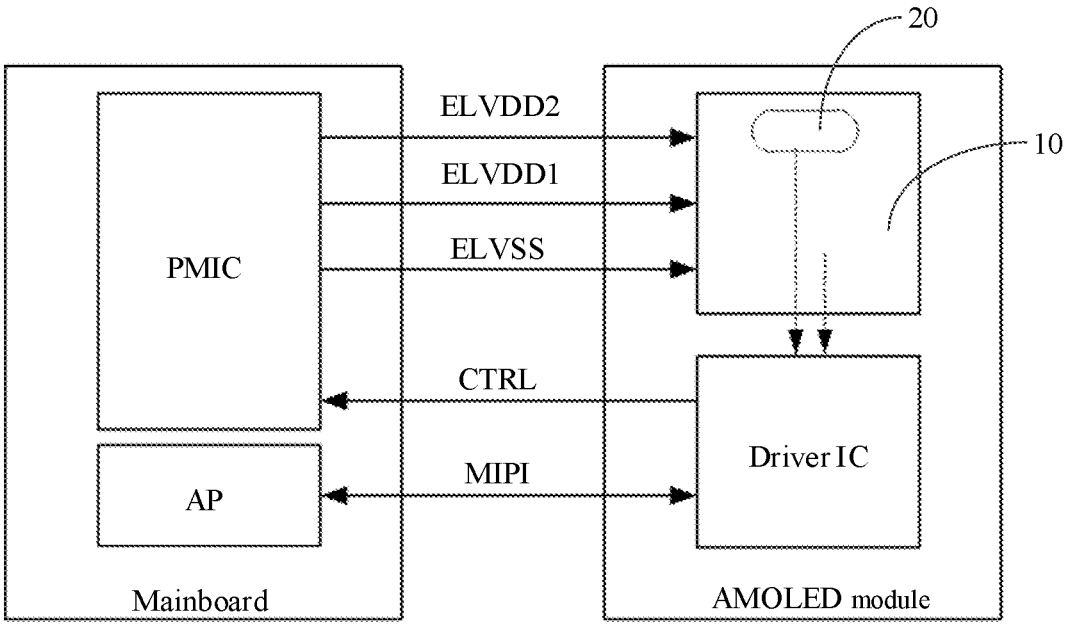
FIG. 7 is a second schematic structural diagram of a display device provided in an embodiment of the present disclosure.

As shown in FIG. 1 to FIG. 5, an embodiment of the present disclosure provides a luminance compensation method for a display device, and the display device includes a display region and a peripheral region located on a periphery of the display region, where the display region includes a first pixel region 10 and a second pixel region 20, the second pixel region 20 has a lower pixel density than the first pixel region 10; the luminance compensation method includes: as shown in FIG. 6 and FIG. 7, obtaining first light-emitting luminance information of the first pixel region 10 and second light-emitting luminance information of the second pixel region 20; adjusting a power supply signal of the first pixel region 10 and/or a power supply signal of the second pixel region 20, respectively, according to the first light-emitting luminance information of the first pixel region 10 and the second light-emitting luminance information of the second pixel region 20.

Illustratively, the display device includes a display region and a peripheral region, the peripheral region surrounds the display region, and the display region includes a first pixel region 10 and a second pixel region 20. The second pixel region 20 has a lower pixel density than the first pixel region 10, and the second pixel region 20 is used to set up structures such as a camera module or an infrared light sensor in the display device.

The second pixel region 20 has various shapes. Illustratively, the second pixel region 20 includes various shapes such as a circle, an ellipse, a square, and a special shape. In a non-camera application scenario, the second pixel region 20 may be used to display time, power, communication signals, and other content. The first pixel region 10 is a normal full-pixel display region, used for various application program interface display and the like.

Figure 9:
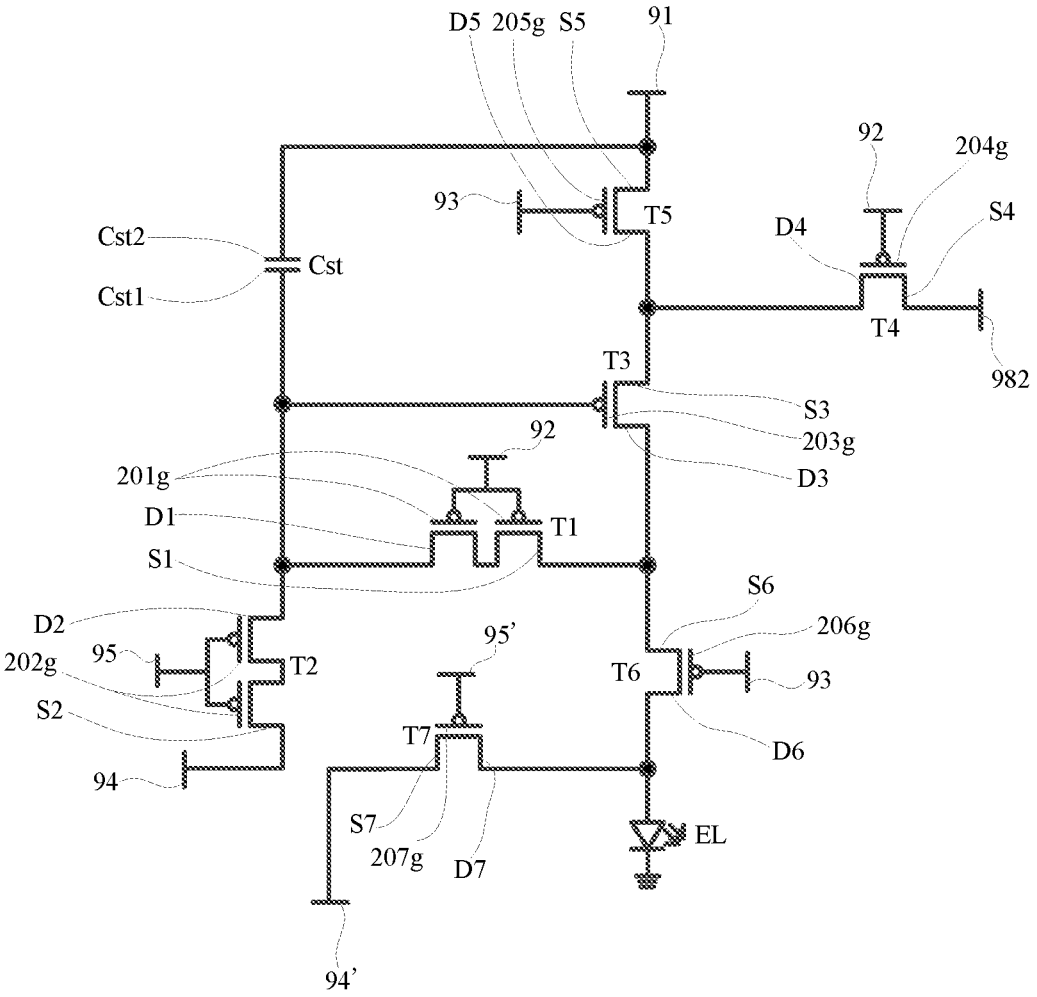
FIG. 9 is a schematic structural diagram of a pixel drive circuit provided in an embodiment of the present disclosure.
Figure 10:
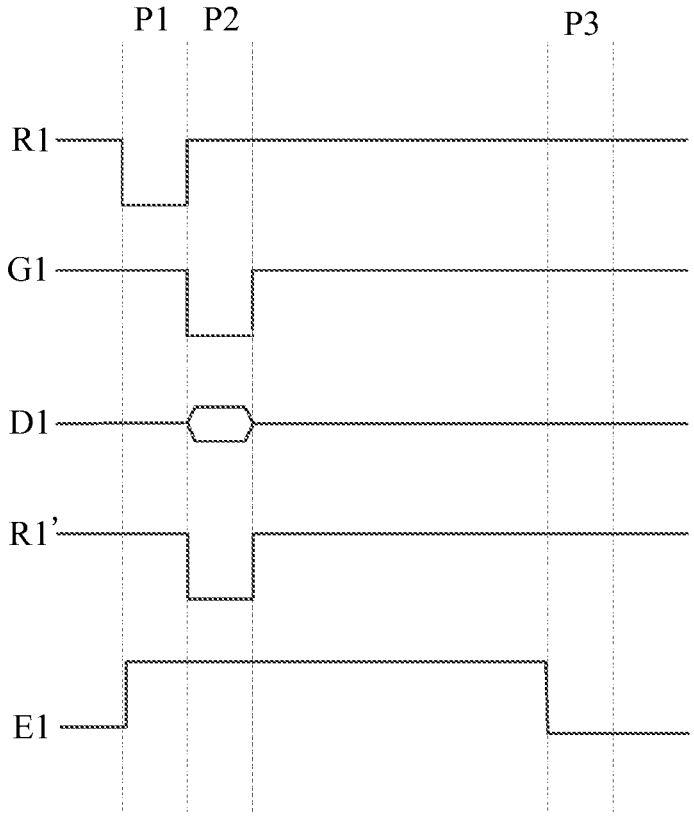
FIG. 10 is a timing diagram of an operation of a pixel drive circuit provided in an embodiment of the present disclosure.

As shown in FIGS. 9 and 10, specific structures of pixel drive circuits in the first pixel region 10 and the second pixel region 20 are the same. Illustratively, the pixel drive circuits all include 7T1C, that is, 7 thin film transistors and 1 capacitor. Each transistor included in the pixel drive circuit adopts a P-type transistor, a first electrode of each transistor includes a source, and a second electrode of each transistor includes a drain.

A first transistor T1 has a double-gate structure. A gate 201*g* of the first transistor T1 is electrically connected to a gate line pattern 92, and a source S1 of the first transistor T1 is electrically connected to a drain D3 of a third transistor T3 (that is, a drive transistor). A drain D1 of the first transistor T1 is electrically connected to a gate 203*g* of the third transistor T3.

A second transistor T2 has a double-gate structure, a gate 202*g* of the second transistor T2 is electrically connected to a reset signal line pattern 95, and a source S2 of the second transistor T2 is electrically connected to an initialization signal line pattern 94, and a drain D2 of the second transistor T2 is electrically connected to the gate 203*g* of the third transistor T3.

A gate 204*g* of a fourth transistor T4 (that is, a data writing transistor) is electrically connected to the gate line pattern 92, and a source S4 of the fourth transistor T4 is electrically connected to a first data line pattern 981 or a second data line pattern 982, and a drain D4 of the fourth transistor T4 is electrically connected to the source S3 of the third transistor T3.

A gate 205*g* of a fifth transistor T5 is electrically connected to a light-emitting control signal line pattern 93, a source S5 of the fifth transistor T5 is electrically connected to a power supply signal line pattern 91, and a drain D5 of the fifth transistor T5 is electrically connected to the source S3 of the third transistor T3.

A gate 206*g* of a sixth transistor T6 is electrically connected to the light-emitting control signal line pattern 93, and a source S6 of the sixth transistor T6 is electrically connected to the drain D3 of the third transistor T3, and a drain D6 of the sixth transistor T6 is electrically connected to an anode of a light-emitting element EL.

Agate 207*g* of a seventh transistor T7 is electrically connected to a reset signal line pattern 95' in a next pixel adjacent in the display device along a second direction, a drain D7 of the seventh transistor T7 is electrically connected to the anode of the corresponding light-emitting element EL, and a source S7 of the seventh transistor T7 is electrically connected to an initialization signal line pattern 94' in a next pixel adjacent along the second direction.

A first plate Cst1 of a storage capacitor Cst is multiplexed as the gate 203*g* of the third transistor T3, and a second plate Cst2 of the storage capacitor Cst is electrically connected to the power supply signal line pattern 91.

Figure 1:
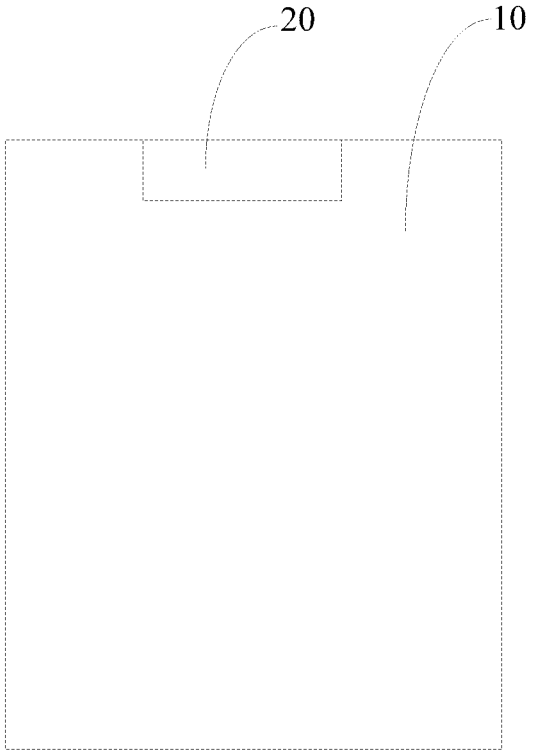
FIG. 1 is a first schematic diagram of a first pixel region and a second pixel region provided in an embodiment of the present disclosure.
Figure 2:
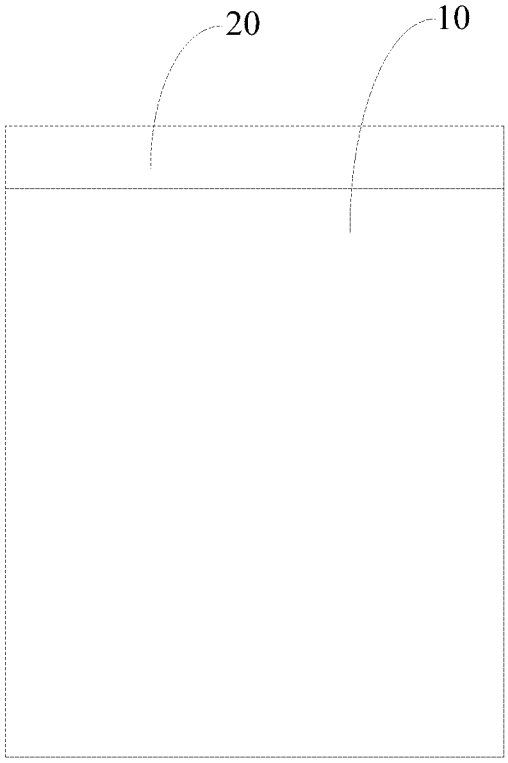
FIG. 2 is a second schematic diagram of a first pixel region and a second pixel region provided in an embodiment of the present disclosure.
Figure 3:
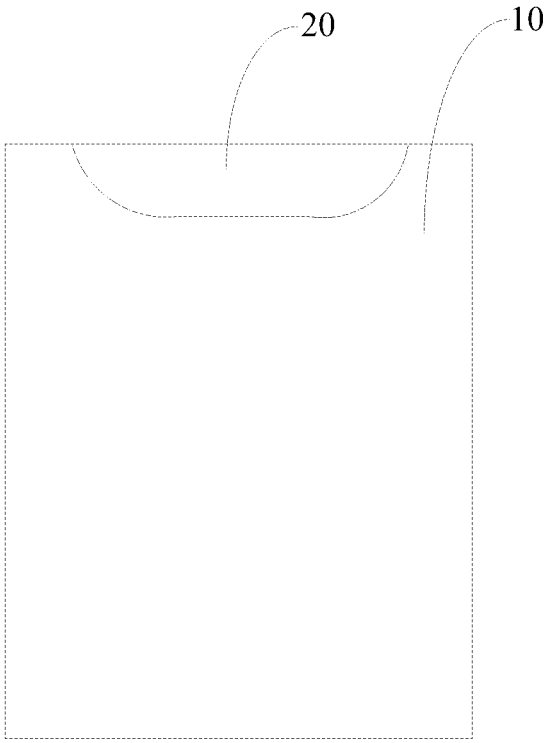
FIG. 3 is a third schematic diagram of a first pixel region and a second pixel region provided in an embodiment of the present disclosure.
Figure 4:
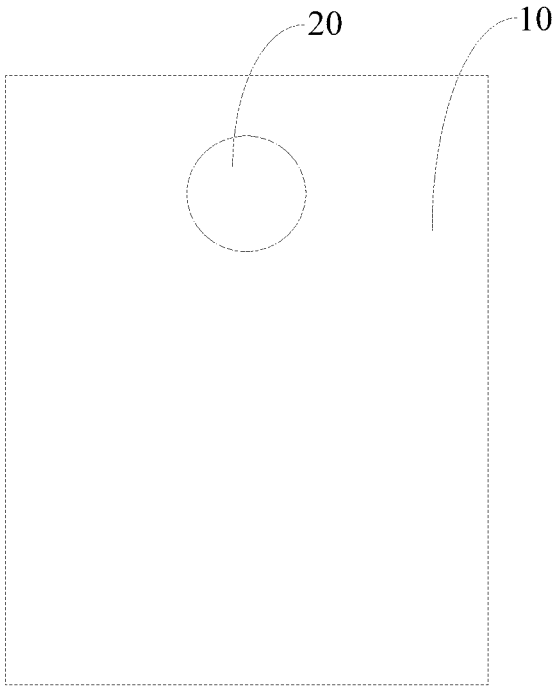
FIG. 4 is a fourth schematic diagram of a first pixel region and a second pixel region provided in an embodiment of the present disclosure.

When the pixel drive circuit with the above structure is in operation, each duty cycle includes a reset period P1, a write compensation period P2, and a light-emitting period P3. In FIG. 3, E1 represents a light-emitting control signal transmitted on the light-emitting control signal line pattern 93 in a current pixel, R1 represents a reset signal transmitted on the reset signal line pattern 95 in the current pixel, D1 represents a data signal transmitted on a data line pattern in the current pixel, G1 represents a gate scan signal transmitted on the gate line pattern 92 in the current pixel, and R1' represents a reset signal transmitted on the reset signal line pattern 95' in a next pixel adjacent to the current pixel along the second direction.

In a first reset period P1, the reset signal input from the reset signal line pattern 95 is at an active level, the second transistor T2 is turned on, and an initialization signal transmitted by the initialization signal line pattern 94 is input to the gate 203*g* of the third transistor T3, so that a gate-source voltage Vgs held on the third transistor T3 in a previous frame is cleared to zero, thereby resetting the gate 203*g* of the third transistor T3.

In a write compensation period P2, the reset signal input from the reset signal line pattern 95 is at an inactive level, the second transistor T2 is turned off, and the gate scan signal input from the gate line pattern 92 is at an active level, the first transistor T1 and the fourth transistor T4 are controlled to be turned on, and the corresponding data line pattern is written into the data signal, which is transmitted to the source S3 of the third transistor T3 through the fourth transistor T4. At the same time, the first transistor T1 and the fourth transistor T4 are turned on, so that the third transistor T3 is formed as Diode structure. Therefore, the first transistor T1, the third transistor T3 and the fourth transistor T4 are in operation together to realize threshold voltage compensation of the third transistor T3. When compensation time is long enough, potential of the gate 203*g* of the third transistor T3 may be controlled to finally reach Vdata+Vth, where Vdata represents a voltage value of the data signal, and Vth represents the threshold voltage of the third transistor T3.

In the writing compensation period P2, the reset signal input from the reset signal line pattern 95' is at an active level, the seventh transistor T7 is controlled to be turned on, and the initialization signal transmitted by the initialization signal line pattern 94' is input to the anode of the light-emitting element EL, and the light-emitting element EL is controlled not to emit light.

In the light-emitting period P3, the light-emitting control signal written by the light-emitting control signal line pattern 93 is at an active level, and the fifth transistor T5 and the sixth transistor T6 are controlled to be turned on, so that the power supply signal transmitted by the power supply signal line pattern 91 is input to the source S3 of the third transistor T3. At the same time, since the potential of the gate 203*g* of the third transistor T3 is kept at Vdata+Vth, the third transistor T3 is turned on. The gate-source voltage corresponding to the third transistor T3 is Vdata+Vth-ELVDD, and ELVDD is a voltage value corresponding to the power supply signal. Drive current generated based on the gate-source voltage flows to the anode of the corresponding light-emitting element EL, and the corresponding light-emitting element EL is driven to emit light.

For the drive current $I_D$=K (Vdata−ELVDD)$^2$, light-emitting luminance of the light-emitting element EL is determined by the drive current. Therefore, adjustment of the light-emitting luminance of the light-emitting element EL may be achieved by adjusting both Vdata and ELVDD.

Illustratively, the first light-emitting luminance information includes actual pixel current of each pixel in the first pixel region 10, and the second light-emitting luminance information includes actual pixel current of each pixel in the second pixel region 20.

The driver IC uses a certain sampling circuit to sample actual pixel current $I_M$ of the first pixel region 10 and the second pixel region 20. Taking the first pixel region 10 as an example, the specific sampling manner includes the following, the first pixel region is divided into multiple sampling regions, each sampling region includes at least 2×2 pixel units, actual pixel current of the light-emitting element EL in each sampling region is collected, average current is calculated, and the average current is used as the actual pixel current of the first pixel region 10, and $I_M$ and $I_D$ corresponding to the first pixel region 10 are compared. If $I_M$ becomes smaller and smaller, that is, a deviation between $I_M$ and $I_D$ becomes larger and larger, which indicates that the aging of the first pixel region 10 is getting more and more serious, and pixel drive ability of the first pixel region 10 becomes worse, resulting in nonuniformity in the luminance of the first pixel region 10 and the second pixel region 20. When the driver IC obtains the feedback actual pixel current, after comparing the actual pixel current with the $I_D$, the driver IC may control to change the power supply signal(s) transmitted to the first pixel region 10 and/or the second pixel region 20.

It should be noted that, a sampling frequency of the pixel current includes: 16 hours, 32 hours, 64 hours, 128 hours, 256 hours, 512 hours, $2^{10}$ hours, $2^{11}$ hours, and $2^{12}$ hours, etc. Illustratively, the pixel current may be fed back to the driver IC at one of these frequencies.

It should be noted that, the power supply signals received in the first pixel region 10 and the second pixel region 20 may be independently controlled. That is, when the power supply signal in the first pixel region 10 is adjusted, the power supply signal in the second pixel region 20 may be kept unchanged; or when the power supply signal in the second pixel region 20 is adjusted, the power supply signal in the first pixel region 10 may be kept unchanged.

In the luminance compensation method for the display device provided in the embodiment of the present disclosure, when the first pixel region 10 and the second pixel region 20 have nonuniformity in the luminance, the power supply signals of the first pixel region 10 and/or a power supply signal of the second pixel region 20 may be adjusted respectively according to the first light-emitting luminance information of the first pixel region 10 and the second light-emitting luminance information of the second pixel region 20. therefore, the drive current of the pixels in the first pixel region 10 and/or the second pixel region 20 is controlled to change, so that the display luminance of the first pixel region 10 and the second pixel region 20 is uniform, thereby realizing the luminance compensation for the display device.

Figure 8:
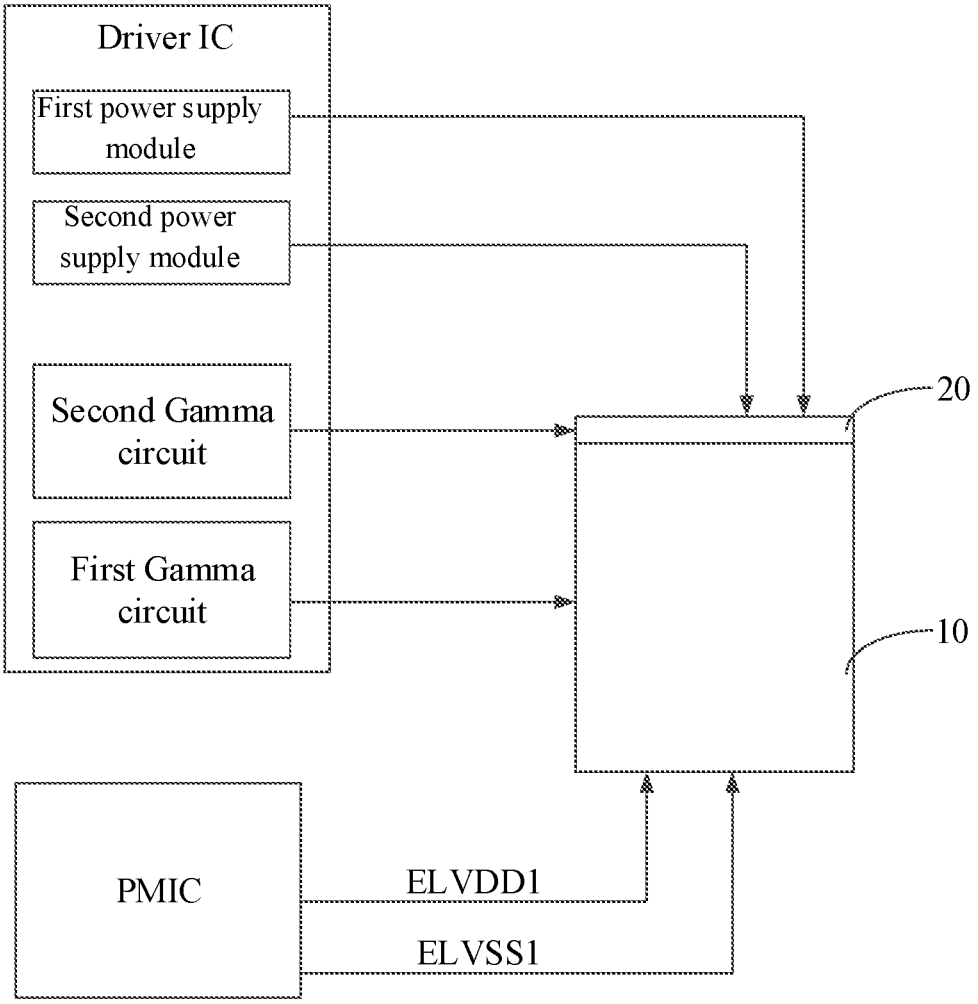
FIG. 8 is a third schematic structural diagram of a display device provided in an embodiment of the present disclosure.

As shown in FIG. 6 to FIG. 8, in some embodiments, the power supply signal includes a the power first power supply signal and/or a the power second power supply signal; the first power supply signal is configured to generate a drive signal for driving pixels to emit light, and a cathode of each pixel in the display device is connected to the second power supply signal.

Illustratively, the first power supply signal includes a positive power supply signal, such as the above ELVDD, and the first power supply signal is configured to generate drive current for driving the pixel to emit light. The second power supply signal includes a negative power supply signal, such as ELVSS, and the second power supply signal is used to write to a cathode of each pixel in the display device.

It should be noted that, in FIG. 6 to FIG. 8, ELVDD1 represents the first power supply signal written into the first pixel region 10, ELVDD2 represents the first power supply signal written into the second pixel region 20; ELVSS1 represents the second power supply signal written into the first pixel region 10, ELVSS2 represents the second power supply signal written in the second pixel region 20. ELVSS in FIG. 7 represents that the first pixel region 10 and the second pixel region 20 share the same second power supply signal. CTRL represents that the driver IC sends a control command to PMIC. MIPI represents a signal transmission interface between the driver IC and a customer's mainboard AP.

In the luminance compensation method, the compensation may be performed in the following manners, but not limited to these.

Manner 1, only the first power supply signal of the first pixel region 10 is adjusted.

Manner 2, only the second power supply signal of the first pixel region 10 is adjusted.

Manner 3, the first power supply signal and the second power supply signal of the first pixel region 10 are adjusted at the same time, and the first power supply signal and the second power supply signal of the second pixel region 20 are not adjusted.

Manner 4, only the first power supply signal of the second pixel region 20 is adjusted.

Manner 5, only the second power supply signal of the second pixel region 20 is adjusted.

Manner 6, the first power supply signal and the second power supply signal of the second pixel region 20 are adjusted at the same time, and the first power supply signal and the second power supply signal of the first pixel region 10 are not adjusted.

Manner 7, the first power supply signal of the first pixel region 10 and the first power supply signal of the second pixel region 20 are adjusted at the same time, the second power supply signal is not adjusted.

Manner 8, the second power supply signal of the first pixel region 10 and the second power supply signal of the second pixel region 20 are adjusted at the same time, the first power supply signal is not adjusted.

Manner 9, the first power supply signal of the first pixel region 10, the first power supply signal of the second pixel region 20 and the second power supply signal of the first pixel region 10 are adjusted at the same time.

Manner 10, the first power supply signal of the first pixel region 10, the first power supply signal of the second pixel region 20 and the second power supply signal of the second pixel region 20 are adjusted at the same time.

Manner 11, the second power supply signal of the first pixel region 10, the second power supply signal of the second pixel region 20 and the first power supply signal of the first pixel region 10 are adjusted at the same time.

Manner 12, the second power supply signal of the first pixel region 10, the second power supply signal of the second pixel region 20 and the first power supply signal of the second pixel region 20 are adjusted at the same time.

Manner 13, the first power supply signal of the first pixel region 10 and the second power supply signal of the second pixel region 20 are adjusted at the same time.

Manner 14, the second power supply signal of the first pixel region 10 and the first power supply signal of the first pixel region 10 are adjusted at the same time.

Manner 15, the first power supply signal and the second power supply signal of the first pixel region 10, and the first power supply signal and the second power supply signal of the second pixel region 20 are adjusted at the same time.

It should be noted that, without adjusting the second power supply signals of the first pixel region 10 and the second pixel region 20, the first pixel region 10 and the second pixel region 20 may share the same second power supply signal.

In the luminance compensation method provided in the above embodiment, the first power supply signal and/or the second power supply signal in the first pixel region 10 and the second pixel region 20 may be adjusted according to the actual needs, so as to better achieve the luminance compensation of the display device.

In some embodiments, when the power supply signal includes the first power supply signal, the adjusting the power supply signal of the first pixel region 10 and/or the power supply signal of the second pixel region 20, respectively, specifically includes: decreasing a voltage value of the first power supply signal of the first pixel region 10 and/or increasing a voltage value of the first power supply signal of the second pixel region 20 when it is determined that light-emitting luminance of the first pixel region 10 is higher than light-emitting luminance of the second pixel region 20 according to the first light-emitting luminance information of the first pixel region 10 and the second light-emitting luminance information of the second pixel region 20; increasing a voltage value of the first power supply signal of the first pixel region 10 and/or decreasing a voltage value of the first power supply signal of the second pixel region 20 when it is determined that light-emitting luminance of the first pixel region 10 is lower than light-emitting luminance of the second pixel region 20 according to the first light-emitting luminance information of the first pixel region 10 and the second light-emitting luminance information of the second pixel region 20.

Specifically, the greater the voltage value of the first power supply signal written into the pixel, the larger the luminance of the pixel, therefore, a luminance relationship between the first pixel region 10 and the second pixel region 20 may be determined according to the obtained first light-emitting luminance information and second light-emitting luminance information, then the voltage value of the first power supply signal(s) of the first pixel region 10 and/or the second pixel region 20 is(are) adjusted.

In some embodiments, when the power supply signal includes the second power supply signal, the adjusting the power supply signal of the first pixel region 10 and/or the power supply signal of the second pixel region 20, respectively, specifically includes: increasing a voltage value of the second power supply signal of the first pixel region 10 and/or decreasing a voltage value of the second power supply signal of the second pixel region 20 when it is determined that light-emitting luminance of the first pixel region 10 is higher than light-emitting luminance of the second pixel region 20 according to the first light-emitting luminance information of the first pixel region 10 and the second light-emitting luminance information of the second pixel region 20; decreasing a voltage value of the second power supply signal of the first pixel region 10 and/or increasing a voltage value of the second power supply signal of the second pixel region 20 when it is determined that light-emitting luminance of the first pixel region 10 is lower than light-emitting luminance of the second pixel region 20 according to the first light-emitting luminance information of the first pixel region 10 and the second light-emitting luminance information of the second pixel region 20.

Specifically, when the second power supply signal includes a negative power supply signal, the greater an absolute value of the voltage value of the first power supply signal written into the pixel, the larger the luminance of the pixel, therefore, a luminance relationship between the first pixel region 10 and the second pixel region 20 may be determined according to the obtained first light-emitting luminance information and second light-emitting luminance information, then the voltage value of the second power supply signal(s) of the first pixel region 10 and/or the second pixel region 20 is(are) adjusted.

As shown in FIG. 5 and FIG. 6, in some embodiments, the adjusting the power supply signal of the first pixel region 10 and/or the power supply signal of the second pixel region 20, respectively, specifically includes: controlling an integrated power supply circuit (PMIC) to adjust the power supply signal provided to the first pixel region 10 and/or the second pixel region 20.

Specifically, the integrated power supply circuit may supply power to a driver IC, and the driver IC may control the PMIC to output a power supply signal. The PMIC is provided on a system mainboard.

The integrated power supply circuit may be controlled by the driver IC to provide a power supply signal to the first pixel region 10 and/or the second pixel region 20, or, by adding a first power supply module and a second power supply module inside the driver IC, the driver IC directly provides a power supply signal to the first pixel region 10 through the first power supply module, and directly provides a power supply signal to the second pixel region 20 through the second power supply module.

Illustratively, when OLED current decreases due to aging, the driver IC controls and adjusts the PMIC to output an appropriate ELVDD voltage to the first pixel region 10 or the second pixel region 20. In order to improve uneven display of the display device caused by the aging of the panel and the decline in current capacity, differences in the display luminance may be better compensated, and service life of the display device may be improved.

Illustratively, the driver IC controls the integrated power supply circuit to provide ELVDD and ELVSS to the first pixel region 10, and the driver IC directly provides ELVDD and ELVSS to the second pixel region 20. By providing different ELVDD and/or ELVSS, a voltage difference between two ends of the light-emitting element EL is changed, thereby changing the light-emitting luminance of the light-emitting element EL.

As shown in FIG. 8, in some embodiments, the display device further includes a first Gamma circuit and a second Gamma circuit; the luminance compensation method further includes: controlling the first Gamma circuit to generate a first Gamma voltage signal according to the first light-emitting luminance information of the first pixel region 10 and the second light-emitting luminance information of the second pixel region 20, and generating a first data signal to be transmitted to the first pixel region 10 according to the first Gamma voltage signal; controlling the second Gamma circuit to generate a second Gamma voltage signal according to the first light-emitting luminance information of the first pixel region 10 and the second light-emitting luminance information of the second pixel region 20, and generating a second data signal to be transmitted to the second pixel region 20 according to the second Gamma voltage signal.

Specifically, the first Gamma circuit and the second Gamma circuit are provided inside the driver IC. The first Gamma circuit corresponds to the first pixel region 10 and the second Gamma circuit corresponds to the second pixel region 20.

The first Gamma circuit is configured to generate a first Gamma voltage signal, a first data signal to be transmitted to the first pixel region 10 is generated based on the first Gamma voltage signal, the first data signal is transmitted to the pixel drive circuit in the first pixel region 10 to generate drive current for driving the light-emitting element EL to emit light. The second Gamma circuit is configured to generate a second Gamma voltage signal, a second data signal to be transmitted to the second pixel region 20 is generated based on the second Gamma voltage signal, the second data signal is transmitted to the pixel drive circuit in the second pixel region 20 to generate drive current for driving the light-emitting element EL to emit light.

In the luminance compensation method provided in the foregoing embodiment, Gamma voltage signals corresponding to different pixel regions are generated through independent Gamma circuits according to the first light-emitting luminance information of the first pixel region 10 and the second light-emitting luminance information of the second pixel region 20. Then data signals corresponding to different pixel regions are generated based on the Gamma voltage signals, the data signals corresponding to different pixel regions are written into the corresponding pixel regions, so that the first pixel region 10 and the second pixel region 20 may achieve uniform display luminance and chromaticity.

In the luminance compensation method provided in the foregoing embodiment, three parameters of the data signal(s), ELVDD and ELVSS of the first pixel region 10 and/or the second pixel region 20 may be controlled at the same time according to the first light-emitting luminance information of the first pixel region 10 and the second light-emitting luminance information of the second pixel region 20, to achieve that both luminance and color coordinates of the first pixel region 10 are the same as those of the second pixel region 20.

In some embodiment, when it is determined that light-emitting luminance of the first pixel region 10 is higher than light-emitting luminance of the second pixel region 20 according to the first light-emitting luminance information of the first pixel region 10 and the second light-emitting luminance information of the second pixel region 20, a range of the first Gamma voltage signal generated by the first Gamma circuit is controlled to increase, the first data signal transmitted to the first pixel region 10 is generated according to the first Gamma voltage signal with the increased range; or, a range of the second Gamma voltage signal generated by the second Gamma circuit is controlled to decrease, the second data signal transmitted to the second pixel region 20 is generated according to the second Gamma voltage signal with the decreased range;

When it is determined that light-emitting luminance of the first pixel region 10 is lower than light-emitting luminance of the second pixel region 20 according to the first light-emitting luminance information of the first pixel region 10 and the second light-emitting luminance information of the second pixel region 20, a range of the first Gamma voltage signal generated by the first Gamma circuit is controlled to decrease, the first data signal transmitted to the first pixel region 10 is generated according to the first Gamma voltage signal with the decreased range; or, a range of the second Gamma voltage signal generated by the second Gamma circuit is controlled to increase, the second data signal transmitted to the second pixel region 20 is generated according to the second Gamma voltage signal with the increased range.

Illustratively, the display device has 1024 grayscales, i.e., 0-gray to 1023-gray, Vgsp is a voltage corresponding to the 1023-gray, Vgmp is a voltage corresponding to the 0-gray; Vgsp is the minimum-level grayscale voltage corresponding to the display panel in the brightest state, and Vgmp is the maximum-level grayscale voltage corresponding to the display panel in the darkest state. When the range of the Gamma voltage signal is increased or decreased, vgmp may be fixed to adjust vgsp, or vgsp may be fixed to adjust vgmp. The larger the voltage range of the Gamma voltage signal, the larger the data signal, and the less the pixel display brightness.

An embodiment of the present disclosure further provides a luminance compensation circuit of a display device, which is used to implement the luminance compensation method provided in the above embodiment, the display device includes: a display region and a peripheral region located on a periphery of the display region, where the display region includes a first pixel region 10 and a second pixel region 20, the second pixel region 20 has a lower pixel density than the first pixel region 10; the luminance compensation circuit includes a driver IC.

The driver IC is configured to obtain first light-emitting luminance information of the first pixel region 10 and second light-emitting luminance information of the second pixel region 20.

The driver IC is further configured to adjust a power supply signal of the first pixel region 10 and/or a power supply signal of the second pixel region 20, respectively, according to the first light-emitting luminance information of the first pixel region 10 and the second light-emitting luminance information of the second pixel region 20.

Illustratively, the driver IC is provided in the peripheral region of the display device.

When the luminance compensation circuit provided in the embodiment of the present disclosure is used to implement the above luminance compensation method, when the first pixel region 10 and the second pixel region 20 have non-uniformity in the luminance, the driver IC may adjust the power supply signals of the first pixel region 10 and/or a power supply signal of the second pixel region 20 respectively according to the first light-emitting luminance information of the first pixel region 10 and the second light-emitting luminance information of the second pixel region 20. Therefore, the drive current of the pixels in the first pixel region 10 and/or the second pixel region 20 is controlled to change, so that the display luminance of the first pixel region 10 and the second pixel region 20 is uniform, thereby realizing the luminance compensation for the display device.

In some embodiments, the power supply signal includes a the power first power supply signal and/or a the power second power supply signal; the first power supply signal is configured to generate a drive signal for driving pixels to emit light, and a cathode of each pixel in the display device is connected to the second power supply signal.

In some embodiments, when the power supply signal includes the first power supply signal, the driver IC is further configured to: decrease a voltage value of the first power supply signal of the first pixel region 10 and/or increase a voltage value of the first power supply signal of the second pixel region 20 when it is determined that light-emitting luminance of the first pixel region 10 is higher than light-emitting luminance of the second pixel region 20 according to the first light-emitting luminance information of the first pixel region 10 and the second light-emitting luminance information of the second pixel region 20; increase a voltage value of the first power supply signal of the first pixel region 10 and/or decrease a voltage value of the first power supply signal of the second pixel region 20 when it is determined that light-emitting luminance of the first pixel region 10 is lower than light-emitting luminance of the second pixel region 20 according to the first light-emitting luminance information of the first pixel region 10 and the second light-emitting luminance information of the second pixel region 20.

Specifically, the greater the voltage value of the first power supply signal written into the pixel, the larger the luminance of the pixel, therefore, a luminance relationship between the first pixel region 10 and the second pixel region 20 may be determined by the driver IC according to the obtained first light-emitting luminance information and second light-emitting luminance information, then the voltage value of the first power supply signal(s) of the first pixel region 10 and/or the second pixel region 20 is(are) adjusted.

In some embodiments, when the power supply signal includes the second power supply signal, the driver IC is further configured to: increase a voltage value of the second power supply signal of the first pixel region 10 and/or decrease a voltage value of the second power supply signal of the second pixel region 20 when it is determined that light-emitting luminance of the first pixel region 10 is higher than light-emitting luminance of the second pixel region 20 according to the first light-emitting luminance information of the first pixel region 10 and the second light-emitting luminance information of the second pixel region 20; decrease a voltage value of the second power supply signal of the first pixel region 10 and/or increase a voltage value of the second power supply signal of the second pixel region 20 when it is determined that light-emitting luminance of the first pixel region 10 is lower than light-emitting luminance of the second pixel region 20 according to the first light-emitting luminance information of the first pixel region 10 and the second light-emitting luminance information of the second pixel region 20.

Specifically, when the second power supply signal includes a negative power supply signal, the greater an absolute value of the voltage value of the first power supply signal written into the pixel, the larger the luminance of the pixel, therefore, the driver IC may determine a luminance relationship between the first pixel region 10 and the second pixel region 20 according to the obtained first light-emitting luminance information and second light-emitting luminance information, then the voltage value of the second power supply signal(s) of the first pixel region 10 and/or the second pixel region 20 is(are) adjusted.

In some embodiments, the luminance compensation circuit further includes an integrated power supply circuit, and the integrated power supply circuit is used to supply power to the driver IC.

The driver IC is further configured to: control the integrated power supply circuit to adjust the power supply signal provided to the first pixel region 10 and/or the second pixel region 20.

In some embodiments, the luminance compensation circuit further includes an integrated power supply circuit, and the integrated power supply circuit is used to supply power to the driver IC.

The driver IC is further configured to: control the integrated power supply circuit to adjust the power supply signal provided to the first pixel region 10.

The driver IC is further configured to: directly adjusting the power supply signal provided to the second pixel region 20.

Specifically, the integrated power supply circuit may supply power to a driver IC, and the driver IC may control the PMIC to output a power supply signal. The PMIC is provided on a system mainboard.

The integrated power supply circuit may be controlled by the driver IC to provide a power supply signal to the first pixel region 10 and/or the second pixel region 20, or, by adding a first power supply module and a second power supply module inside the driver IC, the driver IC directly provides a power supply signal to the first pixel region 10 through the first power supply module, and directly provides a power supply signal to the second pixel region 20 through the second power supply module.

Illustratively, when OLED current decreases due to aging, the driver IC controls and adjusts the PMIC to output an appropriate ELVDD voltage to the first pixel region 10 or the second pixel region 20. In order to improve uneven display of the display device caused by the aging of the panel and the decline in current capacity, differences in the display luminance may be better compensated, and service life of the display device may be improved.

Illustratively, the driver IC controls the integrated power supply circuit to provide ELVDD and ELVSS to the first pixel region 10, and the driver IC directly provides ELVDD and ELVSS to the second pixel region 20. By providing different ELVDD and/or ELVSS, a voltage difference between two ends of the light-emitting element EL is changed, thereby changing the light-emitting luminance of the light-emitting element EL.

In some embodiments, the driver IC includes a control sub-circuit, a first Gamma circuit and a second Gamma circuit.

The control sub-circuit is used for: controlling the first Gamma circuit to generate a first Gamma voltage signal according to the first light-emitting luminance information of the first pixel region 10 and the second light-emitting luminance information of the second pixel region 20, and generating a first data signal to be transmitted to the first pixel region 10 according to the first Gamma voltage signal.

The control sub-circuit is used for: controlling the second Gamma circuit to generate a second Gamma voltage signal according to the first light-emitting luminance information of the first pixel region 10 and the second light-emitting luminance information of the second pixel region 20, and generating a second data signal to be transmitted to the second pixel region 20 according to the second Gamma voltage signal.

Specifically, the control sub-circuit, the first Gamma circuit and the second Gamma circuit are provided inside the driver IC. The first Gamma circuit corresponds to the first pixel region 10 and the second Gamma circuit corresponds to the second pixel region 20.

When the luminance compensation circuit provided in the embodiment of the present disclosure is used to implement the above luminance compensation method, the control sub-circuit generates Gamma voltage signals corresponding to different pixel regions through independent Gamma circuits according to the first light-emitting luminance information of the first pixel region 10 and the second light-emitting luminance information of the second pixel region 20, then generates data signals corresponding to different pixel regions based on the Gamma voltage signals, and writes the data signals corresponding to different pixel regions into the corresponding pixel regions, so that the first pixel region 10 and the second pixel region 20 may achieve uniform display luminance and chromaticity.

When the luminance compensation circuit provided in the embodiment of the present disclosure is used to implement the above luminance compensation method, the driver IC controls three parameters of the data signal(s), ELVDD and ELVSS of the first pixel region 10 and/or the second pixel region 20 at the same time according to the first light-emitting luminance information of the first pixel region 10 and the second light-emitting luminance information of the second pixel region 20, to achieve that both luminance and color coordinates of the first pixel region 10 are the same as those of the second pixel region 20.

In some embodiments, the control sub-circuit is further configured to: when it is determined that light-emitting luminance of the first pixel region 10 is higher than light-emitting luminance of the second pixel region 20 according to the first light-emitting luminance information of the first pixel region 10 and the second light-emitting luminance information of the second pixel region 20, control a range of the first Gamma voltage signal generated by the first Gamma circuit to increase, generate the first data signal transmitted to the first pixel region 10 according to the first Gamma voltage signal with the increased range; or, controlling a range of the second Gamma voltage signal generated by the second Gamma circuit to decrease, generate the second data signal transmitted to the second pixel region 20 according to the second Gamma voltage signal with the decreased range; when it is determined that light-emitting luminance of the first pixel region 10 is lower than light-emitting luminance of the second pixel region 20 according to the first light-emitting luminance information of the first pixel region 10 and the second light-emitting luminance information of the second pixel region 20, controlling a range of the first Gamma voltage signal generated by the first Gamma circuit to decrease, generating the first data signal transmitted to the first pixel region 10 according to the first Gamma voltage signal with the decreased range; or, controlling a range of the second Gamma voltage signal generated by the second Gamma circuit to increase, generating the second data signal transmitted to the second pixel region 20 according to the second Gamma voltage signal with the increased range.

An embodiment of the present disclosure further provides a display device, which includes the luminance compensation circuit provided in the foregoing embodiment.

Illustratively, the driver IC and the integrated power supply circuit included in the luminance compensation circuit are provided in the peripheral region of the display device.

It should be noted that, the display device may be any product or component with a display function, such as a TV, a monitor, a digital photo frame, a mobile phone, a tablet computer, and so on.

An embodiment of the present disclosure further provides a luminance compensation circuit of a display device, including: a processor and a memory, where the memory stores computer executable instructions, when the computer executable instructions is performed by the processor, the luminance compensation method for the display device provided in the above embodiment is implemented.

Specifically, when the computer executable instructions are executed by the processor, the following steps are implemented.

The display device includes: a display region and a peripheral region located on a periphery of the display region, where the display region includes a first pixel region and a second pixel region, a pixel density of the second pixel region is lower than a pixel density of the first pixel region; the luminance compensation method includes: obtaining first light-emitting luminance information of the first pixel region and second light-emitting luminance information of the second pixel region; adjusting a power supply signal of the first pixel region and/or a power supply signal of the second pixel region, respectively, according to the first light-emitting luminance information of the first pixel region and the second light-emitting luminance information of the second pixel region.

Optionally, the power supply signal includes a first power supply signal and/or a second power supply signal; the first power supply signal is configured to generate a drive signal for driving pixels to emit light, and a cathode of each pixel in the display device is connected to the second power supply signal.

Optionally, when the power supply signal includes the first power supply signal, the adjusting the power supply signal of the first pixel region and/or the power supply signal of the second pixel region, respectively, specifically includes: decreasing a voltage value of the first power supply signal of the first pixel region and/or increasing a voltage value of the first power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region; increasing a voltage value of the first power supply signal of the first pixel region and/or decreasing a voltage value of the first power supply signal of the second pixel region when it is determined that light-emitting luminance of the first pixel region is lower than light-emitting luminance of the second pixel region according to the first light-emitting luminance information of the first pixel region and the second light-emitting luminance information of the second pixel region.

Optionally, when the power supply signal includes the second power supply signal, the adjusting the power supply signal of the first pixel region and/or the power supply signal of the second pixel region, respectively, specifically includes: increasing a voltage value of the second power supply signal of the first pixel region and/or decreasing a voltage value of the second power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region; decreasing a voltage value of the second power supply signal of the first pixel region and/or increasing a voltage value of the second power supply signal of the second pixel region when it is determined that light-emitting luminance of the first pixel region is lower than light-emitting luminance of the second pixel region according to the first light-emitting luminance information of the first pixel region and the second light-emitting luminance information of the second pixel region.

Optionally, the adjusting the power supply signal of the first pixel region and/or the power supply signal of the second pixel region, respectively, specifically includes: controlling an integrated power supply circuit to adjust the power supply signal provided to the first pixel region and/or the second pixel region.

Optionally, the display device further includes a first Gamma circuit and a second Gamma circuit; the luminance compensation method further includes: controlling the first Gamma circuit to generate a first Gamma voltage signal according to the first light-emitting luminance information of the first pixel region and the second light-emitting luminance information of the second pixel region, and generating a first data signal to be transmitted to the first pixel region according to the first Gamma voltage signal; controlling the second Gamma circuit to generate a second Gamma voltage signal according to the first light-emitting luminance information of the first pixel region and the second light-emitting luminance information of the second pixel region, and generating a second data signal to be transmitted to the second pixel region according to the second Gamma voltage signal.

Optionally, when it is determined that light-emitting luminance of the first pixel region is higher than light-emitting luminance of the second pixel region according to the first light-emitting luminance information of the first pixel region and the second light-emitting luminance information of the second pixel region, a range of the first Gamma voltage signal generated by the first Gamma circuit is controlled to increase, the first data signal transmitted to the first pixel region is generated according to the first Gamma voltage signal with the increased range; or, a range of the second Gamma voltage signal generated by the second Gamma circuit is controlled to decrease, the second data signal transmitted to the second pixel region is generated according to the second Gamma voltage signal with the decreased range.

When it is determined that light-emitting luminance of the first pixel region is lower than light-emitting luminance of the second pixel region according to the first light-emitting luminance information of the first pixel region and the second light-emitting luminance information of the second pixel region, a range of the first Gamma voltage signal generated by the first Gamma circuit is controlled to decrease, the first data signal transmitted to the first pixel region is generated according to the first Gamma voltage signal with the decreased range; or, a range of the second Gamma voltage signal generated by the second Gamma circuit is controlled to increase, the second data signal transmitted to the second pixel region is generated according to the second Gamma voltage signal with the increased range.

When the luminance compensation device of the display device provided in the embodiment of the present disclosure is used to implement the above method, when the first pixel region and the second pixel region have nonuniformity in the luminance, the processor may adjust the power supply signals of the first pixel region and/or a power supply signal of the second pixel region respectively according to the first light-emitting luminance information of the first pixel region and the second light-emitting luminance information of the second pixel region. therefore, the drive current of the pixels in the first pixel region and/or the second pixel region is controlled to change, so that the display luminance of the first pixel region and the second pixel region is uniform, thereby realizing the luminance compensation for the display device.

When the luminance compensation device of the display device provided in the embodiment of the present disclosure is used to implement the above method, the processor may adjust the first power supply signal and/or the second power supply signal in the first pixel region and the second pixel region according to the actual needs, so as to better achieve the luminance compensation of the display device.

When the luminance compensation device of the display device provided in the embodiment of the present disclosure is used to implement the above method, the processor generates Gamma voltage signals corresponding to different pixel regions through independent Gamma circuits according to the first light-emitting luminance information of the first pixel region and the second light-emitting luminance information of the second pixel region, then generates data signals corresponding to different pixel regions based on the Gamma voltage signals, and writes the data signals corresponding to different pixel regions into the corresponding pixel regions, so that the first pixel region and the second pixel region may achieve uniform display luminance and chromaticity.

When the luminance compensation device of the display device provided in the embodiment of the present disclosure is used to implement the above method, the processor controls three parameters of the data signal(s), ELVDD and ELVSS of the first pixel region and/or the second pixel region at the same time according to the first light-emitting luminance information of the first pixel region and the second light-emitting luminance information of the second pixel region, to achieve that both luminance and color coordinates of the first pixel region are the same as those of the second pixel region.

An embodiment of the present disclosure further provides a non-volatile storage media storing computer executable instructions thereon, when the computer executable instructions is performed by a processor, various processes in embodiments of the luminance compensation method for the display device provided in the above embodiment may be implemented, and the same technical effect may be achieved, which will not be repeated herein to avoid repetition. The computer readable storage medium may be, for example, a read-only memory (ROM), a random access memory (RAM), a magnetic disk or an optical disk, etc.

It should be noted that, each embodiment in the present specification is described in a progressive manner, and the same or similar parts between the various embodiments may be referred to each other. Each embodiment focuses on the differences from other embodiments. In particular, as for the product embodiment, since it is basically similar to the method embodiment, it is described relatively simply, and the relevant part may refer to the description of the product embodiment.

Unless defined otherwise, technical and scientific terms used in the present disclosure have common meaning understood by those of ordinary skill in the art to which the present disclosure belong. The terms "first", "second", and the like used in the present disclosure do not indicate any order, any quantity, or any importance, but are only used to distinguish different components. Words such as "include" or "comprise" mean that the elements or items appearing before the word cover elements or items appearing after the word and the equivalent thereof without excluding other elements or items. Words such as "connected", "coupled", "coupling" or "connecting" are not limited to physical or mechanical connections, but may include electrical connections, and refer to either direct or indirect. "Up", "down", "left", "right", etc. are only used to indicate the relative position relationship. When the absolute position of the described object changes, the relative position relationship may also change accordingly.

It may be understood that when an element such as a layer, a film, a region, or a substrate is referred to as being located "on" or "under" another element, it can be "directly" located "on" or "under" the other element, or intervening elements may also be present.

In the description of the foregoing embodiments, specific features, structures, materials, or characteristics may be combined in a suitable manner in any one or more embodiments or examples.

The aforementioned are merely specific implementations of the present disclosure, but the scope of the disclosure is by no means limited thereto. Any modifications or substitutions that would easily occurred to those skilled in the art, without departing from the technical scope disclosed in the disclosure, should be encompassed in the scope of the present disclosure. Therefore, the scope of the present disclosure is to be determined by the scope of the claims.

What is claimed is:

1. A luminance compensation method for a display device, the display device comprising:

a display region; and a peripheral region located on a periphery of the display region, wherein the display region comprises a first pixel region and a second pixel region, a pixel density of the second pixel region is lower than a pixel density of the first pixel region; the luminance compensation method comprises:

obtaining first light-emitting luminance information of the first pixel region and second light-emitting luminance information of the second pixel region; and adjusting a power supply signal of the first pixel region and/or a power supply signal of the second pixel region, respectively, according to the first light-emitting luminance information of the first pixel region and the second light-emitting luminance information of the second pixel region, wherein the power supply signal comprises a first power supply signal, the first power supply signal is configured to generate a drive signal for driving pixels to emit light, wherein the power supply signal further comprises a second power supply signal, and a cathode of each pixel in the display device is connected to the second power supply signal, and wherein when the power supply signal comprises the first power supply signal and the second power supply signal, the adjusting the power supply signal of the first pixel region and/or the power supply signal of the second pixel region, respectively, comprises:

when it is determined that light-emitting luminance of the first pixel region is lower than light-emitting luminance of the second pixel region according to the first light-emitting luminance information of the first pixel region and the second light-emitting luminance information of the second pixel region;

increasing a voltage value of the first power supply signal of the first pixel region and/or decreasing a voltage value of the first power supply signal of the second pixel region; and decreasing a voltage value of the second power supply signal of the first pixel region and/or increasing a voltage value of the second power supply signal of the second pixel region.

2. The luminance compensation method for the display device according to claim 1, wherein when the power supply signal comprises the first power supply signal, the adjusting the power supply signal of the first pixel region and/or the power supply signal of the second pixel region, respectively, further comprises decreasing a voltage value of the first power supply signal of the first pixel region and/or increasing a voltage value of the first power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region.

3. The luminance compensation method for the display device according to claim 1, wherein when the power supply signal comprises the second power supply signal, the adjusting the power supply signal of the first pixel region and/or the power supply signal of the second pixel region, respectively, comprises:

increasing a voltage value of the second power supply signal of the first pixel region and/or decreasing a voltage value of the second power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region.

4. The luminance compensation method for the display device according to claim 1, wherein the adjusting the power supply signal of the first pixel region and/or the power supply signal of the second pixel region, respectively, comprises controlling an integrated power supply circuit to adjust the power supply signal provided to the first pixel region and/or the second pixel region.

5. The luminance compensation method for the display device according to claim 1, wherein, the display device further comprises a first Gamma circuit and a second Gamma circuit; the luminance compensation method further comprises:

controlling the first Gamma circuit to generate a first Gamma voltage signal according to the first light-emitting luminance information of the first pixel region and the second light-emitting luminance information of the second pixel region, and generating, according to the first Gamma voltage signal, a first data signal to be transmitted to the first pixel region; and controlling the second Gamma circuit to generate a second Gamma voltage signal according to the first light-emitting luminance information of the first pixel region and the second light-emitting luminance information of the second pixel region, and generating, according to the second Gamma voltage signal, a second data signal to be transmitted to the second pixel region.

6. The luminance compensation method for the display device according to claim 5, wherein, when it is determined that light-emitting luminance of the first pixel region is higher than light-emitting luminance of the second pixel region according to the first light-emitting luminance information of the first pixel region and the second light-emitting luminance information of the second pixel region, a range of the first Gamma voltage signal generated by the first Gamma circuit is controlled to increase, the first data signal to be transmitted to the first pixel region is generated according to the first Gamma voltage signal with the increased range; or, a range of the second Gamma voltage signal generated by the second Gamma circuit is controlled to decrease, the second data signal to be transmitted to the second pixel region is generated according to the second Gamma voltage signal with the decreased range, and wherein, when it is determined that light-emitting luminance of the first pixel region is lower than light-emitting luminance of the second pixel region according to the first light-emitting luminance information of the first pixel region and the second light-emitting luminance information of the second pixel region, a range of the first Gamma voltage signal generated by the first Gamma circuit is controlled to decrease, the first data signal to be transmitted to the first pixel region is generated according to the first Gamma voltage signal with the decreased range; or, a range of the second Gamma voltage signal generated by the second Gamma circuit is controlled to increase, the second data signal to be transmitted to the second pixel region is generated according to the second Gamma voltage signal with the increased range.

7. A luminance compensation circuit of a display device, the display device comprising:

a display region; and a peripheral region located on a periphery of the display region, wherein the display region comprises a first pixel region and a second pixel region, a pixel density of the second pixel region is lower than a pixel density of the first pixel region; the luminance compensation circuit comprises a driver integrated circuit (IC), wherein the driver IC is configured to obtain first light-emitting luminance information of the first pixel region and second light-emitting luminance information of the second pixel region, wherein the driver IC is further configured to adjust a power supply signal of the first pixel region and/or a power supply signal of the second pixel region, respectively, according to the first light-emitting luminance information of the first pixel region and the second light-emitting luminance information of the second pixel region, wherein the power supply signal comprises a first power supply signal, the first power supply signal is configured to generate a drive signal for driving pixels to emit light, wherein the power supply signal further comprises a second power supply signal, and a cathode of each pixel in the display device is connected to the second power supply signal, and wherein when the power supply signal comprises the first power supply signal and the second power supply signal, the driver IC is further configured to:

when it is determined that light-emitting luminance of the first pixel region is lower than light-emitting luminance of the second pixel region according to the first light-emitting luminance information of the first pixel region and the second light-emitting luminance information of the second pixel region;

increase a voltage value of the first power supply signal of the first pixel region and/or decrease a voltage value of the first power supply signal of the second pixel region; and decrease a voltage value of the second power supply signal of the first pixel region and/or increase a voltage value of the second power supply signal of the second pixel region.

8. A luminance compensation circuit of a display device, comprising: a processor and a memory, wherein the memory stores computer executable instructions, when the computer executable instructions is performed by the processor, the luminance compensation method for the display device according to claim 1.

9. A non-transitory storage media, storing computer executable instructions thereon, wherein when the computer executable instructions is performed by a processor, the luminance compensation method for the display device according to claim 1 is implemented.

10. The luminance compensation circuit of the display device according to claim 7, wherein when the power supply signal comprises the first power supply signal, the driver IC is further configured to decrease a voltage value of the first power supply signal of the first pixel region and/or increase a voltage value of the first power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region.

11. The luminance compensation circuit of the display device according to claim 7, wherein when the power supply signal comprises the second power supply signal, the driver IC is further configured to:

increase a voltage value of the second power supply signal of the first pixel region and/or decrease a voltage value of the second power supply signal of the second pixel region when it is determined that light-emitting luminance of the first pixel region is higher than light-emitting luminance of the second pixel region according to the first light-emitting luminance information of the first pixel region and the second light-emitting luminance information of the second pixel region.

12. The luminance compensation circuit of the display device according to claim 7, wherein the luminance compensation circuit further comprises an integrated power supply circuit, and the integrated power supply circuit is used to supply power to the driver IC, and wherein the driver IC is further configured to: control the integrated power supply circuit to adjust the power supply signal provided to the first pixel region and/or the second pixel region.

13. The luminance compensation circuit of the display device according to claim 7, wherein the luminance compensation circuit further comprises an integrated power supply circuit, and the integrated power supply circuit is used to supply power to the driver IC, wherein the driver IC is further configured to: control the integrated power supply circuit to adjust the power supply signal provided to the first pixel region, and wherein the driver IC is further configured to: directly adjust the power supply signal provided to the second pixel region.

14. The luminance compensation method of the display device according to claim 7, wherein the driver IC comprises a control sub-circuit, a first Gamma circuit and a second Gamma circuit, wherein the control sub-circuit is configured to: control the first Gamma circuit to generate a first Gamma voltage signal according to the first light-emitting luminance information of the first pixel region and the second light-emitting luminance information of the second pixel region, and generate, according to the first Gamma voltage signal, a first data signal to be transmitted to the first pixel region, and wherein the control sub-circuit is further configured to: control the second Gamma circuit to generate a second Gamma voltage signal according to the first light-emitting luminance information of the first pixel region and the second light-emitting luminance information of the second pixel region, and generate, according to the second Gamma voltage signal, a second data signal to be transmitted to the second pixel region.

15. The luminance compensation circuit of the display device according to claim 14, wherein, the control sub-circuit is further configured to:

when it is determined that light-emitting luminance of the first pixel region is higher than light-emitting luminance of the second pixel region according to the first light-emitting luminance information of the first pixel region and the second light-emitting luminance information of the second pixel region, control a range of the first Gamma voltage signal generated by the first Gamma circuit to increase, generate the first data signal to be transmitted to the first pixel region according to the first Gamma voltage signal with the increased range; or, control a range of the second Gamma voltage signal generated by the second Gamma circuit to decrease, generate the second data signal to be transmitted to the second pixel region according to the second Gamma voltage signal with the decreased range; and when it is determined that light-emitting luminance of the first pixel region is lower than light-emitting luminance of the second pixel region according to the first light-emitting luminance information of the first pixel region and the second light-emitting luminance information of the second pixel region, control a range of the first Gamma voltage signal generated by the first Gamma circuit to decrease, generate the first data signal to be transmitted to the first pixel region according to the first Gamma voltage signal with the decreased range; or, control a range of the second Gamma voltage signal generated by the second Gamma circuit to increase, generate the second data signal to be transmitted to the second pixel region according to the second Gamma voltage signal with the increased range.

16. A display device comprising the luminance compensation circuit according to claim 7.

* * * * *